US006592392B2

(12) United States Patent
Po-Heng

(10) Patent No.: US 6,592,392 B2
(45) Date of Patent: Jul. 15, 2003

(54) DEVICE FOR SECURING PLUG TO SOCKET

(75) Inventor: Chao Po-Heng, Taoyuan Shien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/778,345

(22) Filed: Feb. 6, 2001

(65) Prior Publication Data

US 2002/0068475 A1 Jun. 6, 2002

(30) Foreign Application Priority Data

Dec. 4, 2000 (TW) ..... 89221053 U

(51) Int. Cl.[7] ..... H01R 13/627
(52) U.S. Cl. ..... 439/358; 439/680
(58) Field of Search ..... 439/350, 352, 439/357, 358, 680

(56) References Cited

U.S. PATENT DOCUMENTS 5,342,221 A * 8/1994 Peterson ..... 439/677
5,628,648 A * 5/1997 Higgins, Jr. et al. ..... 439/352
5,788,527 A * 8/1998 Sanders et al. ..... 439/352
5,830,002 A * 11/1998 Ito et al. ..... 439/358
6,007,362 A * 12/1999 Davis et al. ..... 439/358
6,022,246 A * 2/2000 Ko ..... 439/680

FOREIGN PATENT DOCUMENTS

JP 02030075 A * 1/1990

* cited by examiner

*Primary Examiner*—Gary Paumen
*Assistant Examiner*—James R. Harvey
(74) *Attorney, Agent, or Firm*—Richard Gilly, Esq.; Wolf, Block, Schorr & Solis Cohen

(57) ABSTRACT

A securing device used for tightly securing a plug to a socket is provided. The securing device has a casing for tightly securing a plug to a socket and fitting various sizes of plugs. The securing device includes a plug having a clamping element, and a socket having a fitting element corresponding to the clamping element and capable of being clamped by the clamping element for securing the plug to the socket.

9 Claims, 7 Drawing Sheets

DEVICE FOR SECURING PLUG TO SOCKET

FIELD OF THE INVENTION

The present invention relates to a securing device, and more particularly to a device for tightly securing a plug to a socket.

BACKGROUND OF THE INVENTION

Nowadays electronic appliances are widely used in every home or working office. Each electronic appliance needs to be plugged into a socket, and therefore electronic energy can be transferred from the power source to the electric appliance.

The conventional connector assembly essentially includes a plug and a socket which are engaged with each other.

FIG. 1 is a schematic view illustrating the connection of a plug and a socket according to the prior art. The designed connection of the conventional plug 10 and the conventional socket 11 is according to the precise sizes of them. For tightly connection, the materials of the plug 10 and the socket 11 are considered. The plug 10 is plugged in and drawn out of the socket 11 repeatedly, and then the connection is loose because the receptacles are expanded. It is common that the plug 10 is inadvertently removed from the socket 11. Hence, the supplying electricity is interrupted. The interrupted supplying electricity can not only result in an inconvenience, but also cause damage to the electronic appliances.

FIG. 2 is a schematic view illustrating the connection of an electronic appliance assembly and a plug according to the prior art. The socket 21 is mounted in the electronic appliance 2 for engaging with the plug 22. Because there is no securing device for facilitating the connection of the electronic appliance 2 and the plug 22, the foresaid drawback still exists.

Referring to FIG. 3, it is a schematic view of a buckle device for securing a plug to a socket according to the prior art. The prong 311 disposed on the plug 31 is parallel with the conductive blades 312, which are used for being plugged into the receptacles 321. In addition, the hole 322 is used for receiving the prong 311. When the plug 31 is engaged with the socket 32, the prong 311 is plugged into the hole 322 and the protruding portion 313 of the prong 311 is buckled into the lock 323 to secure the engagement. However, additional springs or resilient blades (not shown) are needed to be installed in the interior of the socket in the prior art, which results in high manufacturing cost and complicated assembly.

In order to overcome the drawbacks described above, the present invention provides a securing device for securing a plug to a socket.

SUMMARY OF THE INVENTION

It is therefore an object of the present invention to provide a securing device used for tightly securing a plug to a socket.

In accordance with the present invention, the securing device includes a plug having a clamping element, and a socket having a fitting element corresponding to the clamping element and capable of being clamped by the clamping element for securing the plug to the socket. The clamping element could be integrally formed with the plug or engaged separately with the plug.

In addition, the clamping element is disposed on a surface of the plug. The clamping element is made of elastic materials. Furthermore, the clamping element comprises a slab, a hook portion disposed on a first end of the slab for engaging with the fitting element of the socket, a supporting rib connected with the slab and the plug for supporting the slab, and a pressing portion disposed on a second end of the slab for allowing a user to press thereon and thereby disengaging the hook portion from the fitting element.

In accordance with the present invention, the fitting element comprises a slope portion disposed on a first side of the fitting element, and a retaining portion disposed on a second side opposite to the first side of the fitting element for engaging with the hook portion.

Certainly, the plug and the socket are used for an electric appliance.

In addition, the plug further comprises a first plug hole, and the socket further comprises a first conductive terminal capable of being received in the first plug hole when the plug is plugged into the socket.

Moreover, the socket further comprises a second plug hole, and the plug further comprises a second conductive terminal capable of being received in the second plug hole when the plug is plugged into the socket.

It is another object of the present invention to provide a securing device for tightly securing a plug to a socket.

In accordance with the present invention, the securing device includes a plug having a fitting element, and a socket having a clamping element corresponding to the fitting element and capable of being clamped with the fitting element for securing the plug to the socket.

It is still another object of the present invention to provide a plug for engaging with a socket having a fitting element thereon.

In accordance with the present invention, the plug includes a plug body, and a clamping element disposed on a surface of the body for engaging with the fitting element of the socket, thereby securing the plug to the socket, wherein the clamping element includes a slab, a hook portion disposed on a first end of the slab for engaging with the fitting element of the socket, a supporting rib connected with the slab and the plug for supporting the slab, and a pressing portion disposed on a second end of the slab for allowing a user to press thereon and thereby disengaging the hook portion from the fitting element.

It is still another object of the present invention to provide a socket for engaging with a plug having a clamping element thereon.

In accordance with the present invention, the socket includes a socket body, a fitting element disposed on the socket body for engaging with the clamping element of the plug, thereby securing the plug to the socket, wherein the fitting element includes a slope portion disposed on a first side of the fitting element, and a retaining portion disposed on a second side opposite to the first side of the fitting element for engaging with the clamping element of the plug.

It is still another object of the present invention to provide an electronic appliance assembly.

In accordance with the present invention, the electronic appliance assembly includes an electronic appliance, a plug having a clamping element, and a socket mounted on the electronic appliance and having a fitting element corresponding to the clamping element of the plug for engaging with the clamping element of the plug, thereby securing the plug to the socket.

The present invention may best be understood through the following descriptions with reference to the accompanying drawings, in which:

DETAILED DESCRIPTION OF THE PREFERRED EMBODIMENTS

Two preferred embodiments of the present invention are described in detail with reference to FIGS. 4 to 7.

Figure 1:
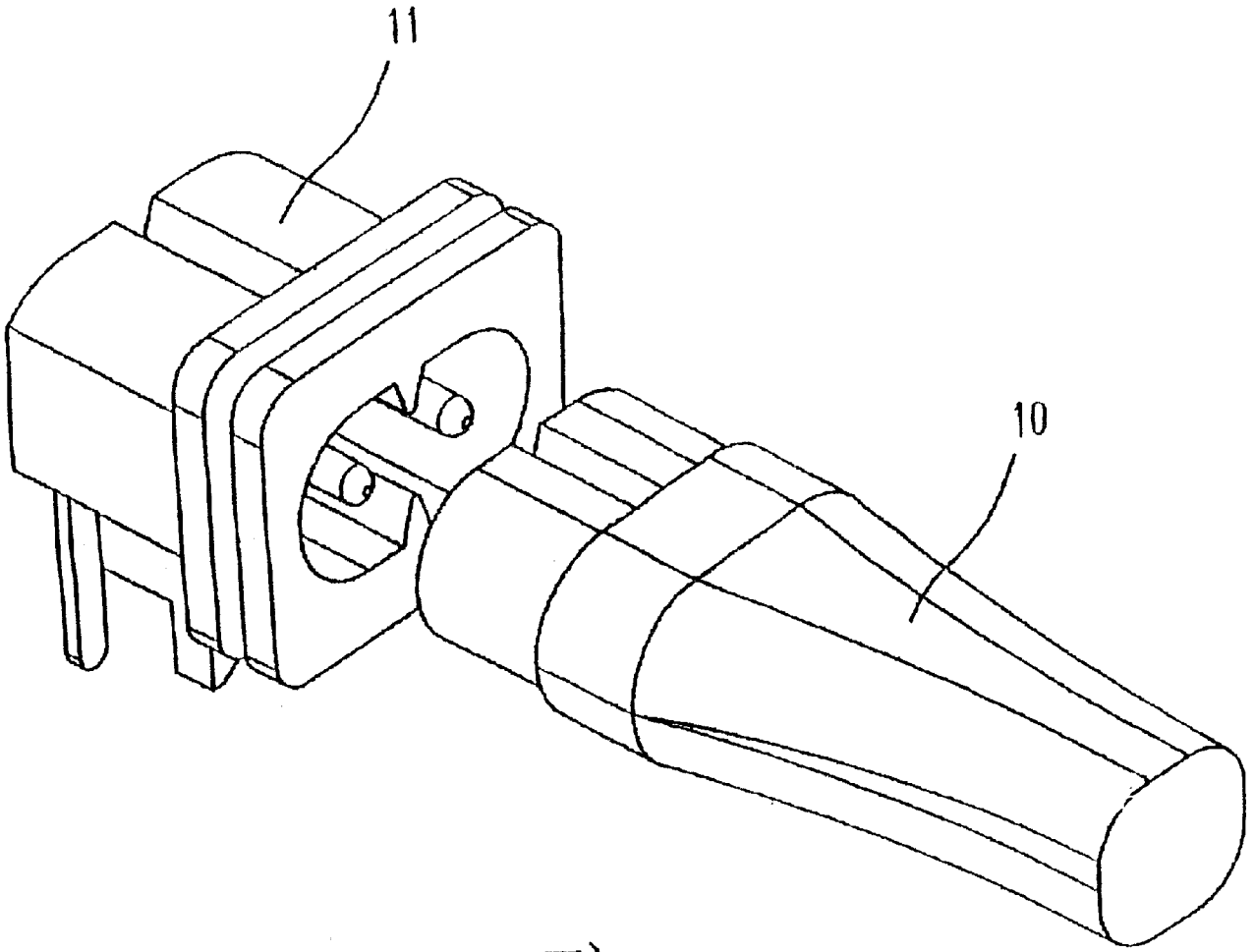
Fig. 1(PRIOR ART)
FIG. 1 is a schematic view illustrating the connection of a plug and a socket according to the prior art.
Figure 2:
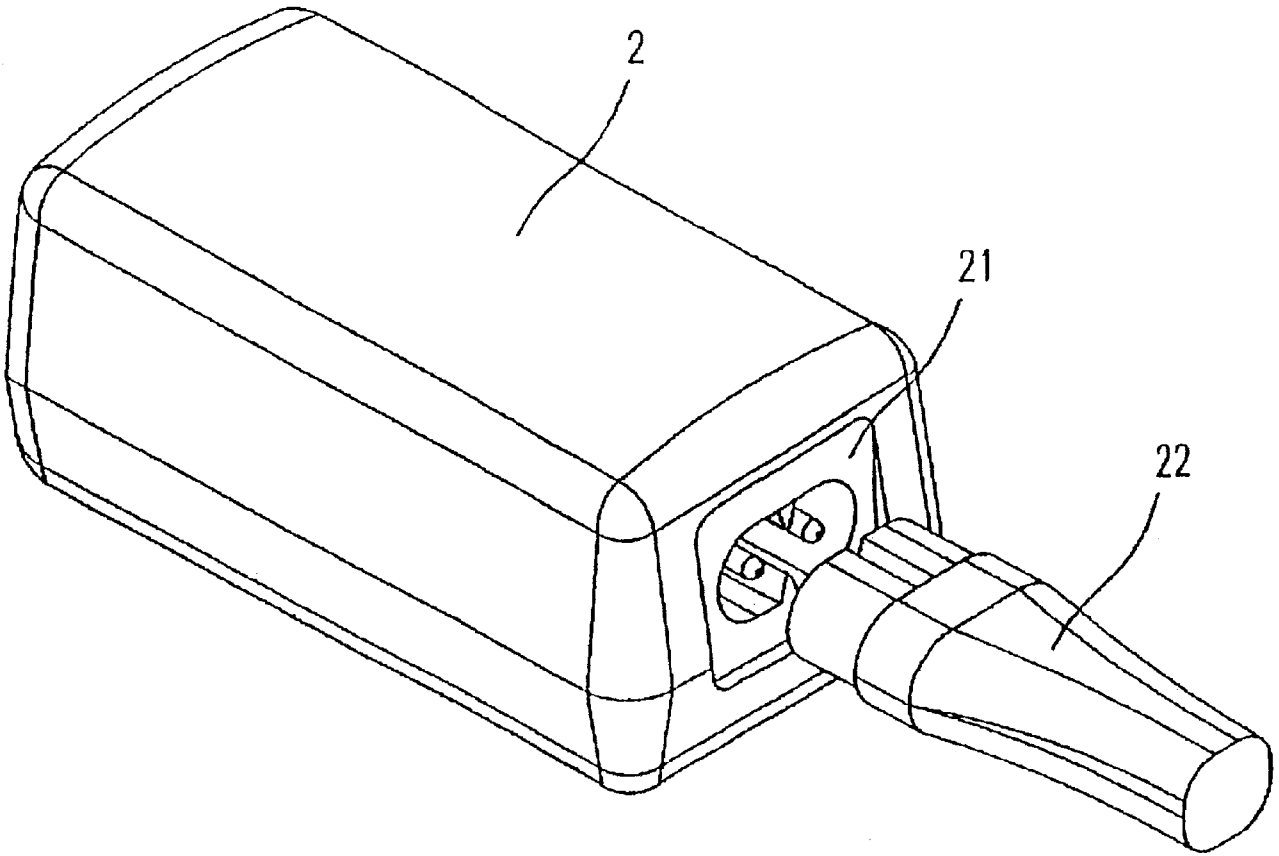
Fig. 2(PRIOR ART)
FIG. 2 is a schematic view illustrating the connection of an electronic appliance and a plug according to the prior art.
Figure 3:
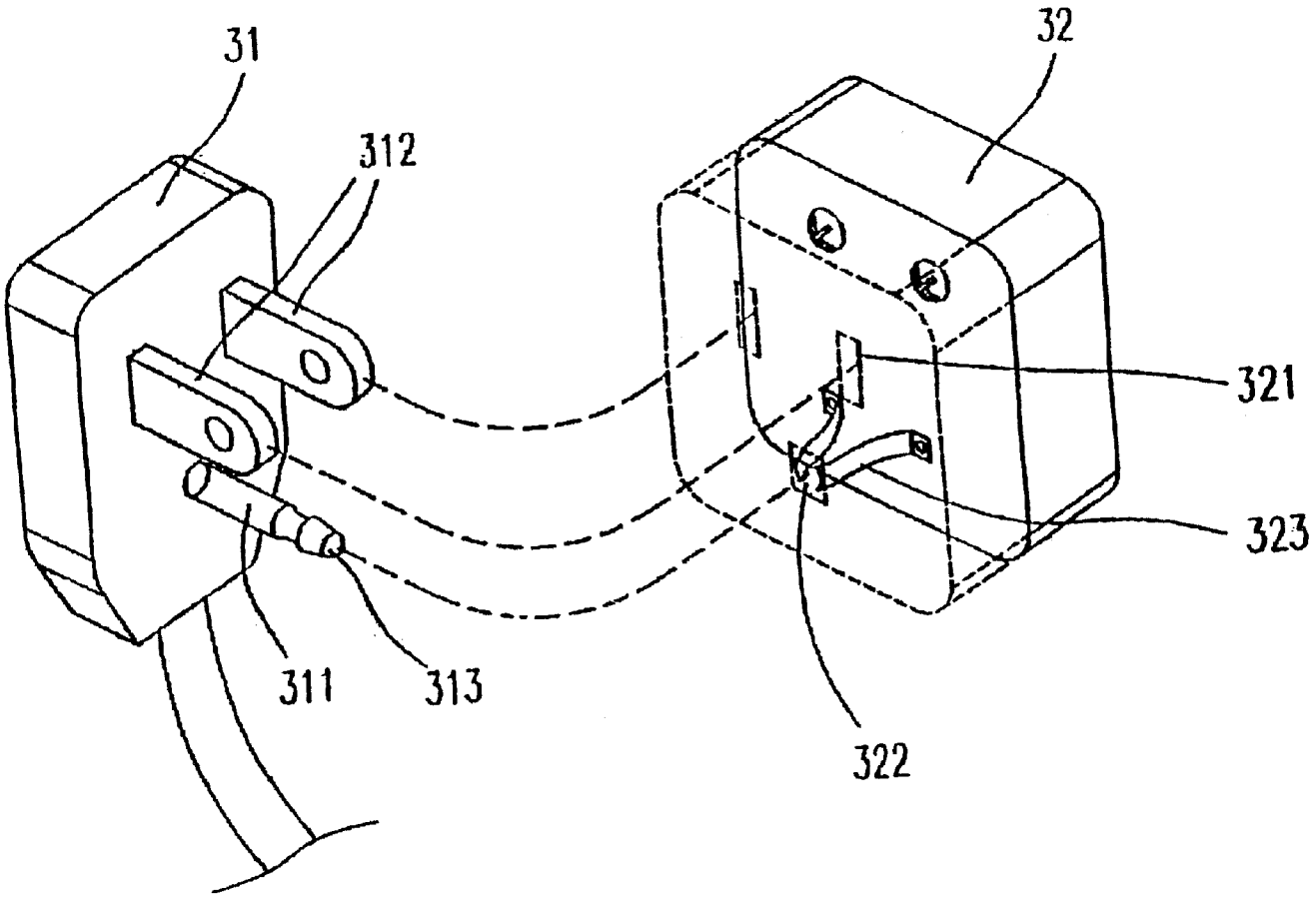
Fig. 3(PRIOR ART)
FIG. 3 is a schematic view of a buckle device for securing a plug to a socket according to the prior art.
Figure 4:
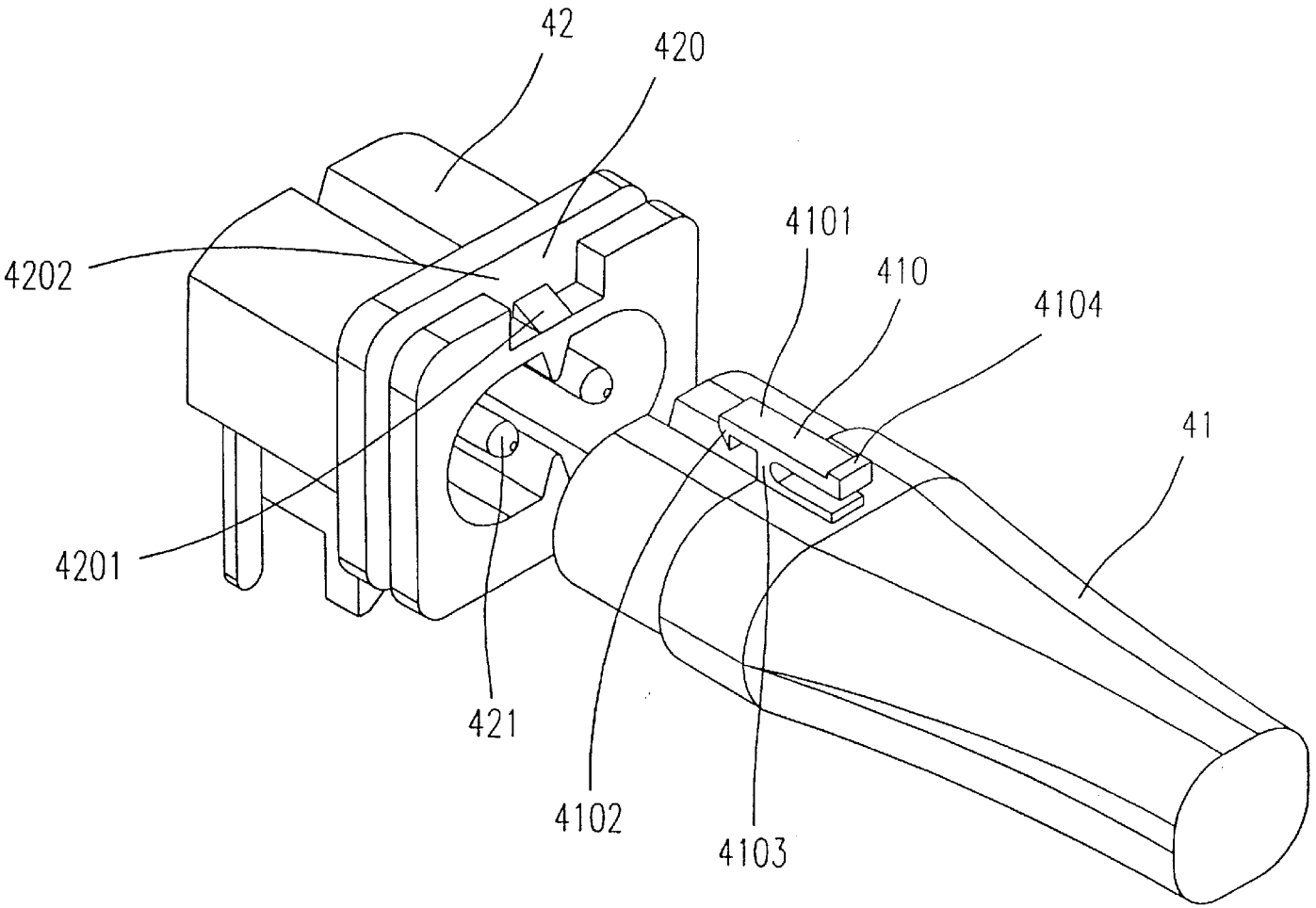
FIG. 4 is a schematic view illustrating the securing device of a plug and a socket according to the first preferred embodiment of the present invention.

As shown in FIG. 4, a plug 41 includes a clamping element 410 disposed on the surface of the plug 41. The clamping element 410 includes a slab 4101, a hook portion 4102, a supporting rib 4103 and a pressing portion 4104. The supporting rib 4103 engaged with the plug 41 and the slab 4101 is used for supporting the slab 4101. In addition, the hook portion 4102 is disposed on the first end of the slab 4101, and the pressing 4104 portion is disposed on the second end of the slab 4101. The pressing portion 4104 is pressed to make the hook portion 4102 move upward and downward.

Certainly, the foresaid clamping element 410 could be integrated with the plug 41 or engaged separately with the plug 41. In addition, the clamping element 410 is preferably made of elastic materials.

The socket 42 includes a fitting element 420, which is fitted to the clamping element 410 and clamped by the clamping element 410 for securing the plug 41 to the socket 42. The fitting element 420 includes the slope 4201 disposed on a first side of the fitting element 420, and the retaining portion 4202, which is disposed on a second side relative to the first side of the fitting element 420. The retaining portion 4202 is used for engaging with the hook portion 4102, thereby securing the plug 41 into the socket 42.

Figure 5:
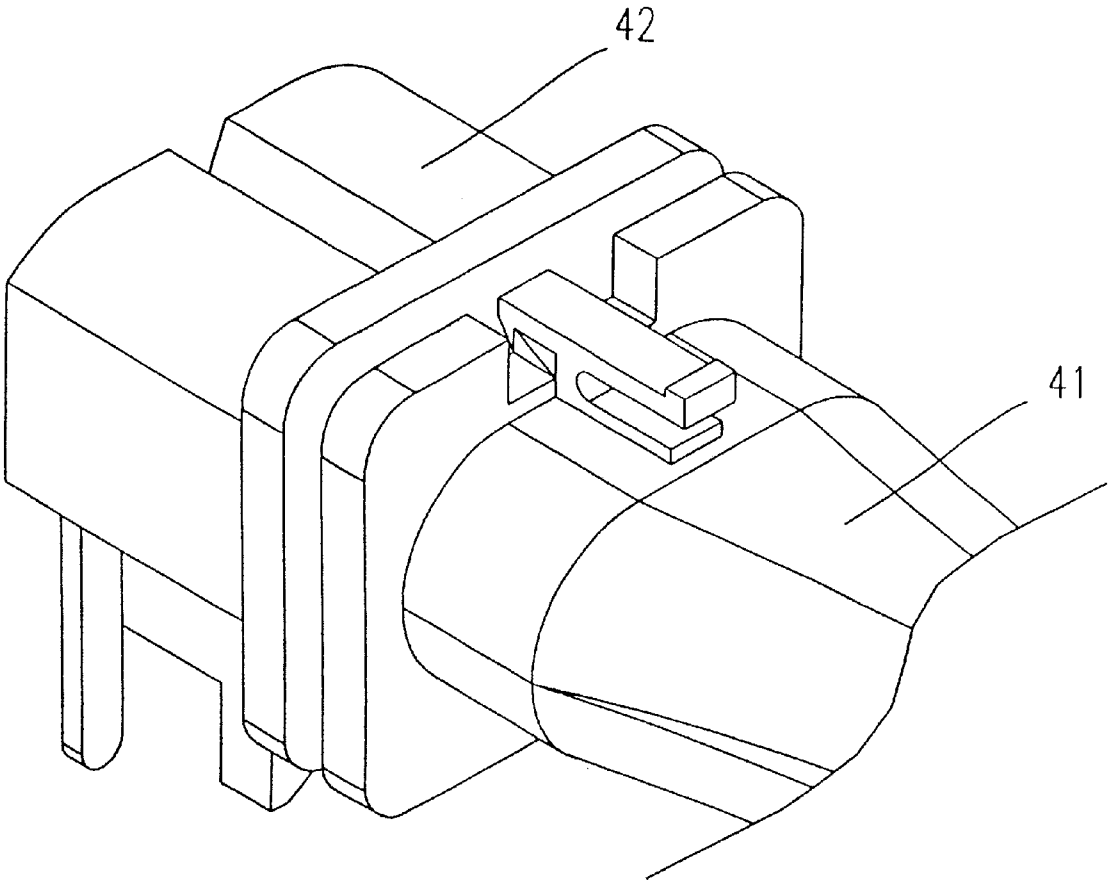
FIG. 5 is a schematic view of the engagement of the plug and the socket in FIG. 4.

The engagement of the plug 41 and the socket 42 is shown in FIG. 5 Please refer to FIG. 4 and FIG. 5, when the plug 41 is plugged into the socket 42, the hook portion 4102 climbs up along the slope 4201 until the hook portion 4102 is engaged with the retaining portion 4202. Therefore, the engagement of the plug 41 and the socket 42 is tightly secured. In addition, when the plug 41 is drawn out of the socket 42, the pressing portion 4104 is pressed. Then the hook portion 4102 is disengaged from the retaining portion 4202, and the plug 41 could be easily drawn out of the socket 42.

Certainly, the foresaid assembly of the plug 41 and the socket 42 could be an assembly of an electrical plug and an electrical socket or a signal plug and a signal socket. If the assembly of an electrical plug and an electrical socket is used, the plug 41 preferably further includes a plug hole (not shown), and the socket 42 further includes a conductive terminal for plugging into the plug hole. Certainly, the plug 41 could further include a conductive terminal, and the socket 42 could further include a socket hole for receiving the conductive terminal of the plug 41.

Furthermore, the number of the clamping elements and the number of the fitting elements are not limited in the present invention. Certainly, the clamping element could be disposed on the socket and the fitting element could be disposed on the plug according to the present invention.

Figure 6:
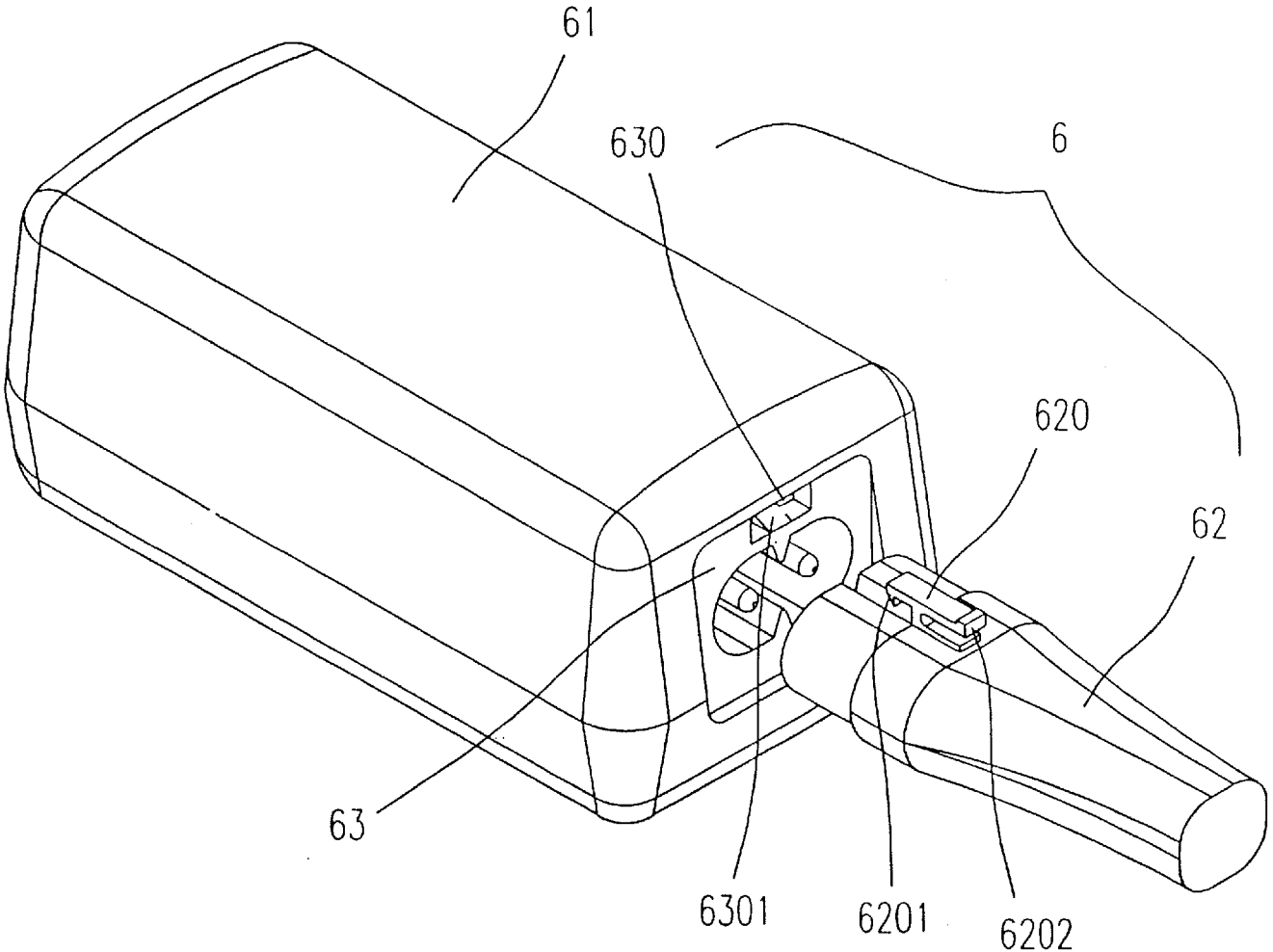
FIG. 6 is a schematic view of the electronic appliance assembly according to the second preferred embodiment of the present invention.

Referring to FIG. 6, it is a schematic view of an electronic appliance assembly according to the second embodiment of the present invention. The electronic appliance assembly 6 includes an electronic appliance 61 and a plug 62. The electronic appliance 61 includes a socket 63 for engaging with the plug 62 including a clamping element 620. The socket 63 includes a fitting element 630 for engaging with the clamping element 620 and securing the plug 62 into the socket 62 installed in the electronic appliance 61.

Figure 7:
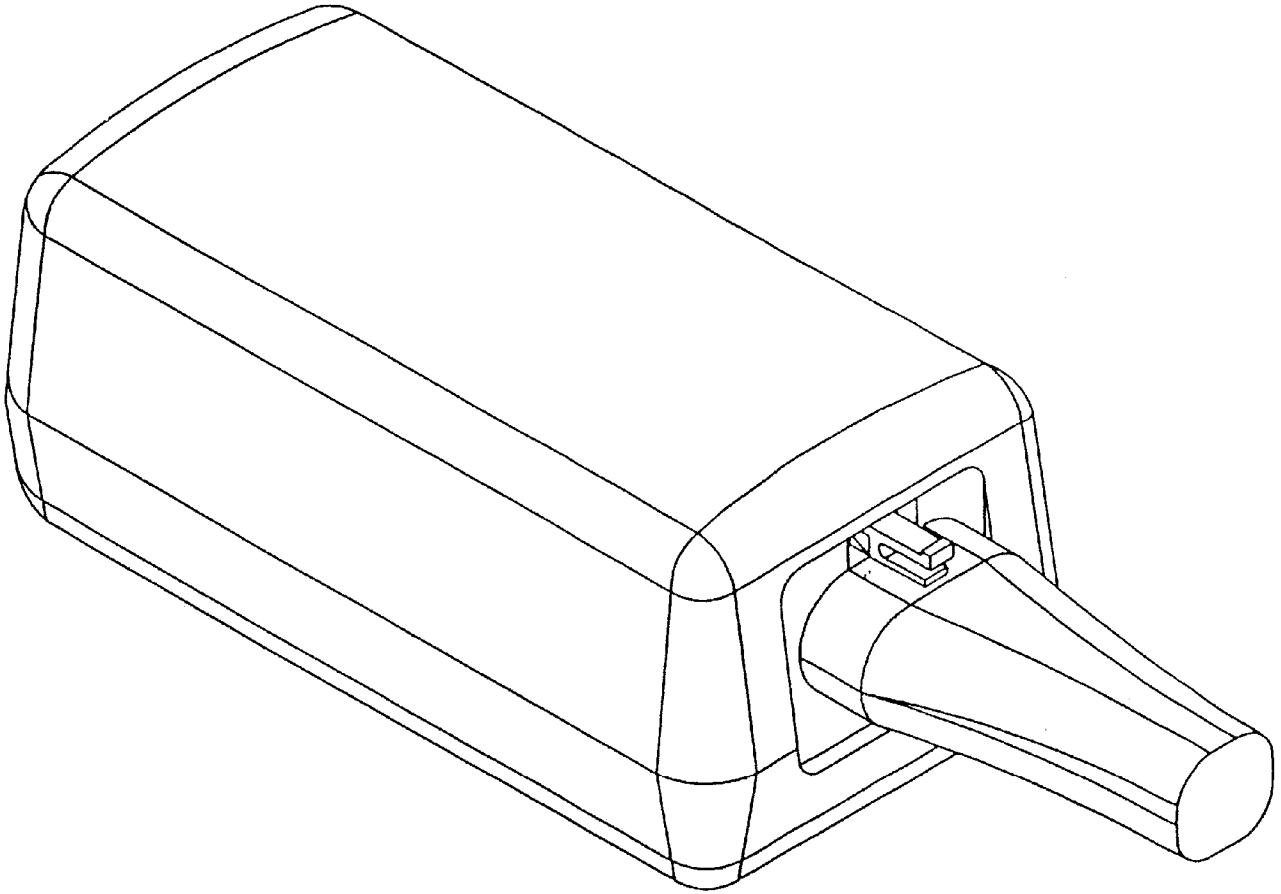
FIG. 7 is a schematic view of the combination of the electronic appliance assembly according to the second preferred embodiment of the present invention.

The engagement of the plug 62 and the socket 63 is shown in FIG. 7 Please refer to FIG. 6 and FIG. 7, when the plug 62 is plugged into the socket 63, a hook portion 6201 climbs up along a slope 6301 until the hook portion 6201 is engaged with the retaining portion (not shown). Therefore, the engagement of the plug 62 and the socket 63 is tightly secured. In addition, when the plug 62 is drawn out of the socket 63, the pressing portion 6202 is pressed. Then the hook portion 6201 is disengaged from the retaining portion, and the plug 62 could be easily drawn out of the socket 63 mounted on the electronic appliance 61.

Certainly, the socket 63 could be integrated with the electronic appliance 61 or engaged additively with the electronic appliance 61. In addition, the foresaid electronic appliance could be an adapter, and a portable adapter of an information equipment is preferred.

Certainly, the electronic appliance of the present invention is not limited to the adapter. The present invention could be adapted to any electronic appliance which needs the engagement of a plug and a socket.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A securing device used for an adapter for tightly securing a plug to a socket comprising:

a plug having a clamping element; and a socket having a fitting element corresponding to said clamping element and capable of being clamped by said clamping element for securing said plug to said socket, wherein said clamping element comprises a slab, a hook portion disposed on a first end of said slab for engaging with said fitting element of said socket, a supporting rib connected with said slab and said plug for supporting said slab, and a pressing portion disposed on a second end of said slab for allowing a user to press thereon and thereby disengaging said hook portion from said fitting element; and wherein said fitting element further includes:

a first flange having a groove;

a slope being in said groove, wherein said groove is in vertical alignment with an upper protrusion and a lower protrusion, wherein said protrusions extend into a cavity of said socket, and are adjacent to a terminal and substantially located in said cavity; and a second flange being rearward of said first flange and spaced a distance from said slope, wherein said first flange and second flange have an outer periphery, and wherein said second flange and said slope define a gap between said second flange and said slope, said hook portion is placed in said gap when said plug and said socket are engaged, and said first end of said slab is adjacent to said second flange when said plug and said socket are engaged.

2. The securing device according to claim 1, wherein said clamping element is integral formed with said plug.

3. The securing device according to claim 1, wherein said clamping element is engaged separately with said plug.

4. The securing device according to claim 1, wherein said clamping element is disposed on a surface of said plug.

5. The securing device according to claim 1, wherein said clamping element is made of elastic materials.

6. The securing device according to claim 1, wherein said plug further comprises a first plug hole, and said socket further comprises a first conductive terminal capable of being received in said first plug hole when said plug is plugged into said socket.

7. An electronic appliance assembly, comprising:

an electronic appliance;

a plug having a clamping element; and a socket having a fitting element corresponding to said clamping element and capable of being clamped by said clamping element for securing said plug to said socket, wherein said clamping element comprises a slab, a hook portion disposed on a first end of said slab for engaging with said fitting element of said socket, a supporting rib connected with said slab and said plug for supporting said slab, and a pressing portion disposed on a second end of said slab for allowing a user to press thereon and thereby disengaging said hook portion from said fitting element; and wherein said fitting element further includes:

a first flange having a groove;

a slope being in said groove, wherein said groove is in vertical alignment with an upper protrusion and a lower protrusion, wherein said protrusions extend into a cavity of said socket, and are adjacent to a terminal and substantially located in said cavity; and a second flange being rearward of said first flange and spaced a distance from said slope, wherein said first flange and second flange have an outer periphery, and wherein said second flange and said slope define a gap between said second flange and said slope, said hook portion is placed in said gap when said plug and said socket are engaged, and said first end of said slab is adjacent to said second flange when said plug and said socket are engaged.

8. The electronic appliance assembly according to claim 7, wherein said electronic appliance is a charger.

9. The electronic appliance assembly according to claim 7, wherein said electronic appliance is an adapter.

* * * * *